US011236485B2

(12) United States Patent
Parzynski, Jr. et al.

(10) Patent No.: US 11,236,485 B2
(45) Date of Patent: Feb. 1, 2022

(54) CUTTING EDGE ASSEMBLY FOR A WORK TOOL ASSOCIATED WITH A MACHINE

(71) Applicant: Caterpillar Inc., Peoria, IL (US)

(72) Inventors: David B. Parzynski, Jr., Peoria, IL (US); Thomas Marshall Congdon, Dunlap, IL (US); George Maska, Glasford, IL (US)

(73) Assignee: Caterpillar Inc., Peoria, IL (US)

( * ) Notice: Subject to any disclaimer, the term of this patent is extended or adjusted under 35 U.S.C. 154(b) by 219 days.

(21) Appl. No.: 16/579,130

(22) Filed: Sep. 23, 2019

(65) Prior Publication Data

US 2021/0087778 A1 Mar. 25, 2021

(51) Int. Cl.
*B22D 19/04* (2006.01)
*E02F 3/815* (2006.01)

(52) U.S. Cl.
CPC ..... *E02F 3/8152* (2013.01); *B22D 19/04* (2013.01)

(58) Field of Classification Search
CPC ..... E02F 3/8152; B22D 19/04
See application file for complete search history.

(56) References Cited

U.S. PATENT DOCUMENTS 1,922,917 A * 8/1933 Russell ..... E02F 9/285 172/701.3
2,887,797 A 5/1959 George
3,882,594 A * 5/1975 Jackson ..... E21B 10/46 228/122.1
4,770,253 A * 9/1988 Hallissy ..... E02F 9/285 172/701.3
5,743,033 A * 4/1998 Gegel ..... B21K 11/00 37/446
5,778,572 A * 7/1998 Lukavich ..... E02F 9/285 172/701.3
5,813,474 A 9/1998 Manway
6,632,045 B1 10/2003 McCartney
7,665,234 B2 2/2010 Diehl et al.
9,290,898 B2 3/2016 Abramczyk et al.
9,821,396 B2 11/2017 Winter
9,863,119 B2 1/2018 Congdon et al.
10,138,607 B2 11/2018 Aquino
2015/0059217 A1 3/2015 Hansen
2019/0177954 A1 6/2019 Congdon et al.

FOREIGN PATENT DOCUMENTS

EP 3374572 9/2018
EP 3527725 8/2019

* cited by examiner

*Primary Examiner* — Ryan J. Walters
(74) *Attorney, Agent, or Firm* — Harrity & Harrity LLP

(57) ABSTRACT

A cutting edge assembly is disclosed. The cutting edge assembly may include an attachment element configured to be attached to a work tool of a machine, wherein the attachment element is formed from a first metal alloy, and wherein the attachment element includes a plurality of retention structures that extend from an attachment end of the attachment element toward a cutting edge end of the attachment element. The cutting edge assembly may include a wear element configured to form a cutting edge of the work tool, wherein the wear element is formed from a second metal alloy that is different from the first metal alloy, and wherein the wear element is cast over the plurality of retention structures to bond the wear element to the attachment element.

20 Claims, 8 Drawing Sheets

CUTTING EDGE ASSEMBLY FOR A WORK TOOL ASSOCIATED WITH A MACHINE

TECHNICAL FIELD

The present disclosure relates generally to a cutting edge and, for example, to a cutting edge assembly with a first metal alloy attachment element and second metal alloy wear element.

BACKGROUND

Machines, for example motor graders, dozers, wheel loaders, and excavators are commonly used in material moving applications. These machines include a work tool having a cutting edge component (e.g., a ground engaging element) configured to contact the material. For example, motor graders are typically used to perform displacement, distribution and leveling of material, such as rock and/or soil. The motor graders may move the work tool over the ground so that the cutting edge component engages with the rock and/or soil so as to displace, distribute, or level the rock and/or soil.

During use of the cutting edge component, the material may abrade the cutting edge component, causing the cutting edge component to erode or wear away. Accordingly, the cutting edge component may be removably attached to the work tool and replaced on a periodic basis. Conventional cutting edge components may be formed primarily of a single piece of steel and/or may include a serrated cutting edge comprised of a plurality of exposed teeth to enhance material moving applications. Further, cutting edge components on motor graders and/or other types of heavy equipment experience relatively high rates of wear depending on the type of material being moved by the motor graders.

One approach for a wear component of a cutting edge component is disclosed in U.S. Patent Application Publication No. 2019/0177954 that published on Jun. 13, 2019 ("the '954 reference"). In particular, the '954 reference discloses that the wear component may include at least one wear portion connected to the support surface, and the at least one wear portion may form at least one ground engaging edge. The at least one wear portion may include a mild steel body and a plurality of longitudinally-spaced white cast iron teeth vacuum brazed along a distal, ground engaging edge of the mild steel body.

While the wear component of the cutting edge component of the '954 uses white cast iron teeth for a cutting edge component, the white cast iron teeth are vacuum brazed to the steel body of the cutting edge component.

The cutting edge assembly of the present disclosure solves one or more of the problems set forth above and/or other problems in the art.

SUMMARY

According to some implementations, a cutting edge assembly may include an attachment element configured to be attached to a work tool of a machine, wherein the attachment element is formed from a first metal alloy, and wherein the attachment element includes a plurality of retention structures that extend from an attachment end of the attachment element toward a cutting edge end of the attachment element; and a wear element configured to form a cutting edge of the work tool, wherein the wear element is formed from a second metal alloy that is different from the first metal alloy, and wherein the wear element is cast over the plurality of retention structures to bond the wear element to the attachment element.

According to some implementations, a cutting edge assembly for use on a work tool of a machine may be prepared by a process comprising: forming an attachment element of the cutting edge assembly to have a plurality of retention structures, wherein the attachment element is formed from a first metal alloy, and wherein the attachment element of the cutting edge assembly is configured to be attached to the work tool; contacting the attachment element with a second metal alloy that is in a molten state within a mold, wherein the mold is configured to cast a wear element of the cutting edge assembly; cooling the second metal alloy while the attachment element of the cutting edge assembly is in contact with the second metal alloy; and withdrawing, from the mold, a combination of the first metal alloy and the second metal alloy after the second metal alloy is solidified to form the wear element of the cutting edge assembly.

According to some implementations, a method of manufacturing a cutting edge assembly of a work tool of a machine may include forming an attachment element to include a plurality of retention structures that extend from an attachment end of the cutting edge assembly, wherein the attachment element is formed from a steel material; forming a mold structure for a wear element of the cutting edge assembly; supplying the mold structure with white iron in a molten state; contacting the attachment element with the white iron in the molten state to form a metallurgical bond between the attachment element and the white iron; and curing the metallurgical bond and the white iron to form the cutting edge assembly, wherein the solidified white iron forms the wear element of the cutting edge assembly.

DETAILED DESCRIPTION

This disclosure relates to a cutting edge assembly for a work tool. The cutting edge assembly has universal applicability to any machine utilizing such a work tool. The term "machine" may refer to any machine that performs an operation associated with an industry such as, for example, mining, construction, farming, transportation, or any other industry.

Figure 1:
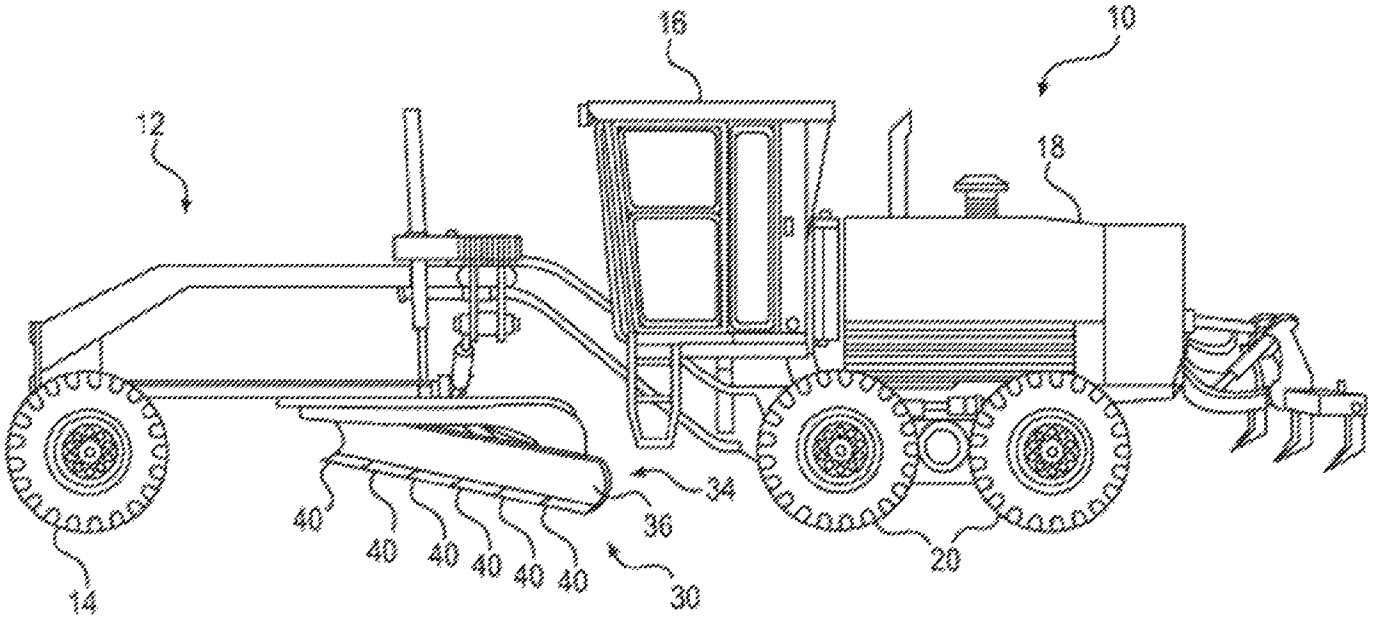
FIG. 1 is a diagram of an example machine that includes a work tool.

FIG. 1 is a diagram of an example machine 10 that includes an example cutting edge assembly described herein. Machine 10 may include, for example, a motor grader, a backhoe loader, an agricultural tractor, a wheel loader, a skid-steer loader, a dozer, an excavator, or any other type of machine known in the art. As a motor grader, machine 10 may include a frame assembly 12. Frame assembly 12 may include a pair of front wheels 14 (or other traction devices) and may support an operator station 16. Frame assembly 12 may also include one or more compartments 18 for housing a power source (e.g., an engine) and associated cooling components. The power source may be operatively coupled to one or more pairs of rear wheels 20 (or other traction devices) for propulsion of machine 10.

Machine 10 may also include one or more work tools 30. The work tool(s) 30 (e.g., a blade, a plow, a bucket, a scraper, a ripper, and/or the like) may include one or more wear components, such as one or more cutting edge assemblies 40. In the case of a motor grader, as shown in FIG. 1, the work tool 30 may include a plurality of the cutting edge assemblies 40 (e.g., six cutting edge components). Alternatively, other quantities of cutting edge assemblies 40 may be provided, depending on the application.

As indicated above, FIG. 1 is provided as an example. Other examples may differ from what is described in connection with FIG. 1.

Figure 2:
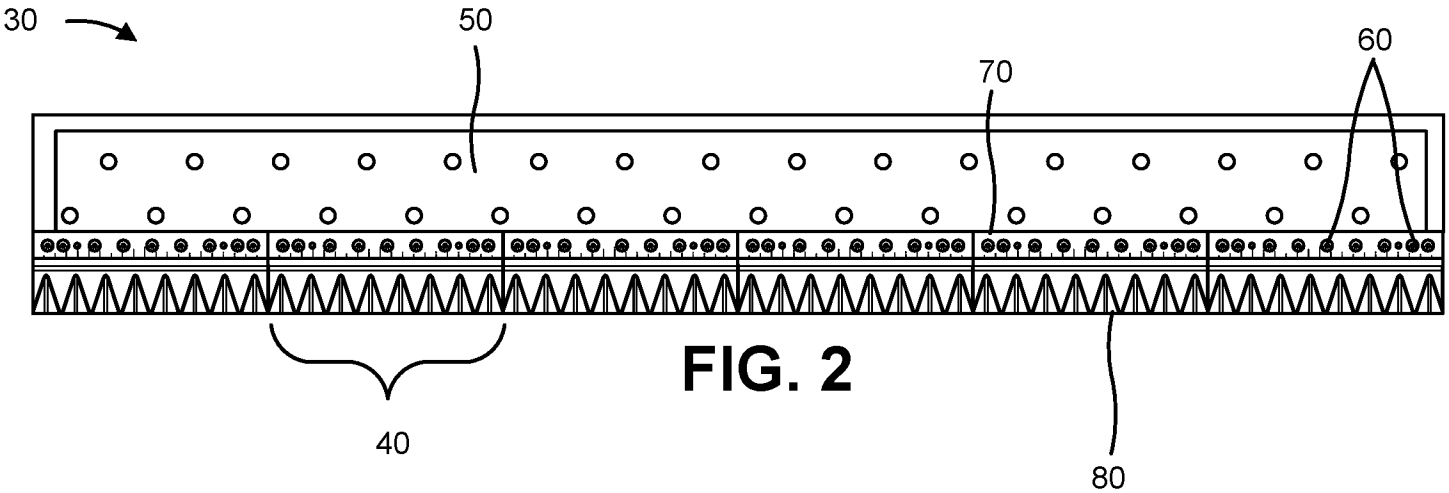
FIG. 2 is a plan view of an example implementation of the work tool of FIG. 1.
Figure 3:
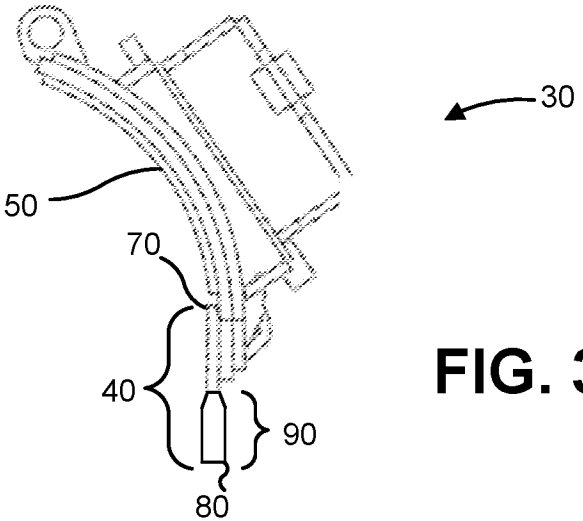
FIG. 3 is an end view of an example implementation of the work tool of FIG. 1.
Figure 4:
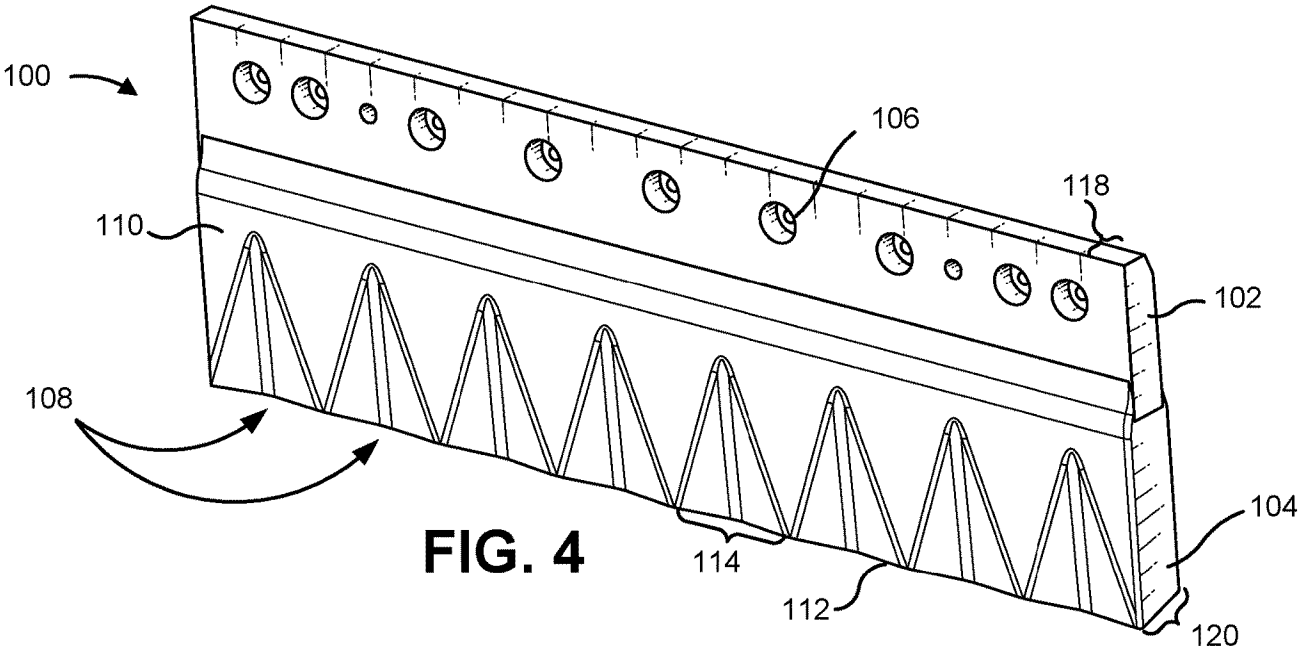
FIG. 4 is an isometric view of an example cutting edge assembly described herein.
Figure 5:
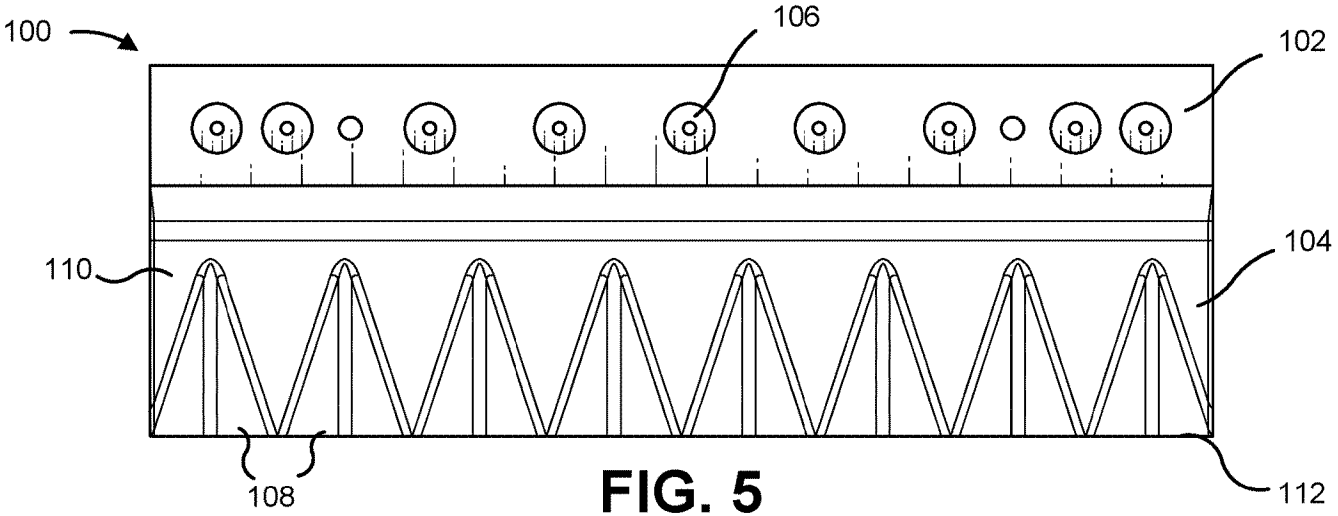
FIG. 5 is a plan view of an example cutting edge assembly described herein.
Figure 6:
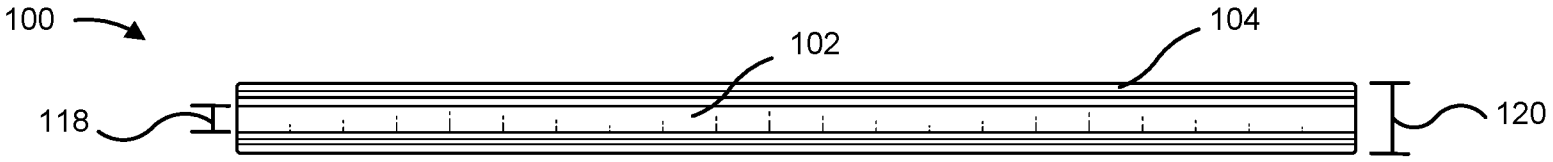
FIG. 6 is a top view of an example cutting edge assembly described herein.
Figure 7:
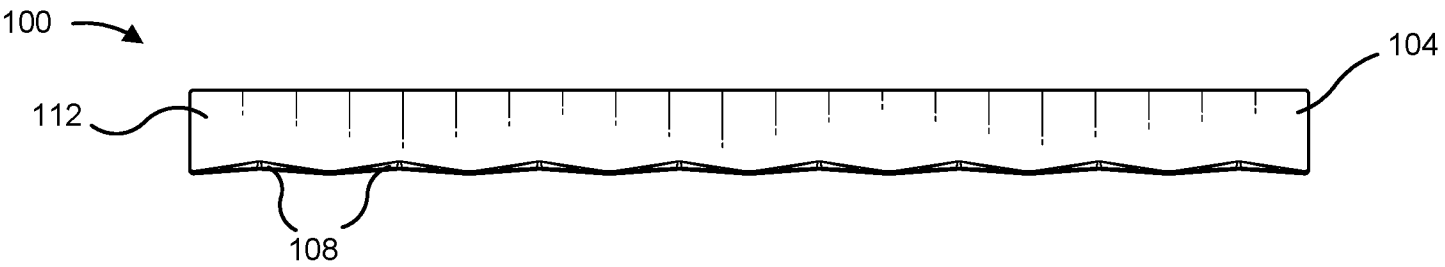
FIG. 7 is a bottom view of an example cutting edge assembly described herein.

FIGS. 2-3 are diagrams of views of an example work tool 30 that includes a plurality of cutting edge assemblies 40, as described herein. Work tool 30 may include a support structure 50 (e.g., a pushing surface of a blade, a plow, and/or the like). Cutting edge assemblies 40 may be attached to the support structure 50 via a plurality of fasteners 60 (e.g., bolts, rivets, screws, and/or the like) toward a proximal end 70 of each of the cutting edge assemblies 40. Cutting edge assemblies 40 may be aligned along the support structure such that a distal end 80 of each of the cutting edge assemblies 40 forms a cutting edge (and/or a ground engaging edge) of work tool 30. Distal end 80 may be within a wear zone 90 of cutting edge assemblies 40 (e.g., the portion of cutting edge assemblies 40 that is most likely to wear away and/or erode during use).

As indicated above, FIG. 2-3 are provided as one or more examples. Other examples may differ from what is described in connection with FIGS. 2-3.

FIGS. 4-7 are diagrams of views of an example cutting edge assembly 100 described herein. Cutting edge assembly 100 may correspond to cutting edge assembly 40 of FIG. 1. As shown in FIGS. 4-7, cutting edge assembly 100 includes an attachment element 102 and a wear element 104. Attachment element 102 may include attachment holes 106 that may be configured to receive fasteners (not shown) to permit cutting edge assembly 100 to be attached to a work tool (e.g., work tool 30) of a machine (e.g., machine 10).

Wear element 104 may include one or more indentations 108 (referred to herein individually as "indentation 108," and collectively as "indentations") that recess into the wear element 104 relative to a face 110 of wear element. Face 110 and indentations 108 may be the surfaces of cutting edge assembly 100 that are configured to engage with ground material, remove ground material, and/or move the ground material based on movement of the machine and work tool. A cutting edge 112 of wear element 104 (and correspondingly, of cutting edge assembly 100) may be a continuous edge, such that a base of wear element 104 is within a same continuous plane. In other words, in this example cutting edge 112 is not considered to be serrated (e.g., cutting edge 112 does not include teeth that extend from a proximal end of cutting edge assembly 100).

Indentations 108 are shown as triangular in shape. However, one or more other shapes may be used—for example, shapes that have a wider lateral distal indentation width 114 toward the cutting edge 112 (which may be referred as a "cutting edge end") than a proximal indentation width 116 toward attachment element 102 of cutting edge assembly 100 (which may be referred to as an "attachment end"). More specifically, the one or more indentations 108 may be trapezoidal, semicircular, and/or the like. Although indentations 108 are shown to have a same shape and size (or same dimensions within a tolerance threshold), individual indentations 108 of wear element 104 may be shaped or sized differently from each other. As described herein, the shapes and/or sizes of indentions 108 may be defined by a mold used to cast wear element 104 over attachment element 102 to form cutting edge assembly 100.

Attachment element 102 may be formed from a first metal alloy, and wear element 104 may be formed from a second metal alloy that is different from the first metal alloy. Attachment element 102 may be formed from a metal alloy that is more flexible and/or has less mass than the metal alloy that is used to form wear element 104. Additionally, or alternatively, wear element 104 may be formed from a metal alloy that has a greater hardness and/or that is more wear resistant than the metal alloy used to form attachment element 102. A relatively less wear resistant metal alloy may be softer and/or may erode more easily than a relatively more wear resistant metal alloy. For example, a relatively less wear resistant metal alloy may erode (e.g., when in contact with a material, such as dirt, rock snow, pavement, and/or the like) more quickly, with less pressure and/or the like than a relatively more wear resistant alloy.

In some implementations, attachment element 102 may be formed from steel (e.g., a carbon-based steel), such as a rolled steel, and wear element 104 may be formed from white iron (e.g., a chrome white iron, such as a 15% alloyed chrome white iron, 26% alloyed chrome white iron, and/or the like). For example, wear element 104 may be cast over attachment element 102, as described herein. In such examples, white iron may be place in a molten state (e.g., greater than 1350 degrees Celsius (C)) and placed in contact with attachment element 102 to form wear element 104 and, ultimately, cutting edge assembly 100. The molten white iron may be placed into contact with attachment element 102 while the molten white iron is included in a mold that is shaped to form wear element 104. Additionally, or alternatively, the white iron may be placed in contact with attachment element 102 by being poured into a mold that already includes attachment element 102 (e.g., attachment element 102 is fixed or suspended within the mold). While examples described herein may refer to attachment element 102 being steel and wear element 104 being white iron, attachment element 102 and wear element 104 may be formed from other suitable metals and/or metal alloys.

Accordingly, as described herein, wear element 104 is configured to be more wear resistant than attachment element 102, thereby improving a wear life of cutting edge assembly 100 relative to cutting edge assembly 100 being formed entirely (or primarily, such as more than 90%) of the metal alloy used to form attachment element 102. Further, attachment element 102 may be more flexible and/or may be less massive than wear element 104, thereby reducing an overall stress on a machine using cutting edge assembly 100 and/or reducing an overall weight of cutting edge assembly 100 relative to cutting edge assembly 100 being formed entirely (or primarily) of the metal alloy used to form wear element 104.

As shown (e.g., in FIGS. 4 and 6), an attachment thickness 118 of attachment element 102 may be less than an overall thickness 120 of wear element 104. Overall thickness 120 may correspond to the thickest portions of cutting edge assembly 100. In this way, the thickest portions of cutting edge assembly 100 may be toward, within, or at a wear zone of cutting edge assembly 100 (e.g., a portion of cutting edge assembly 100 that is similar to wear zone 90), and, therefore, cutting edge assembly 100 may have thickness dimensions that cause material to accumulate at the wear zone so that other portions of cutting edge assembly 100 do not wear away faster than the wear zone of cutting edge assembly 100.

As indicated above, FIGS. 4-7 are provided as one or more examples. Other examples may differ from what is described in connection with FIGS. 4-7.

Figure 8:
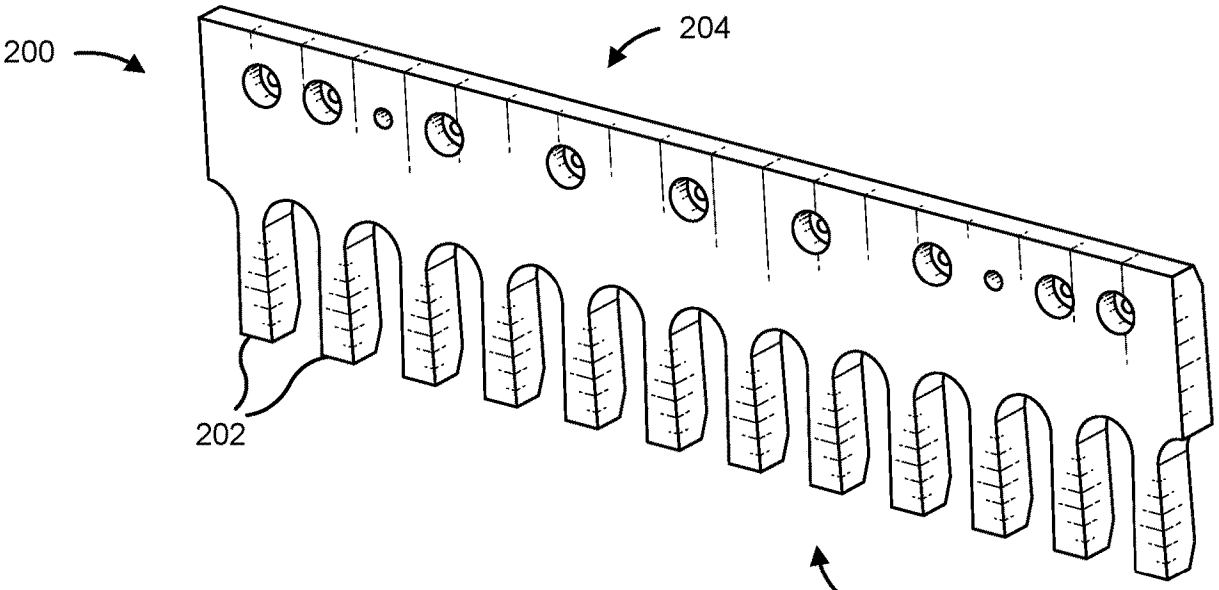
FIG. 8 is an isometric view of an example attachment element of an example cutting edge assembly described herein.
Figure 9:
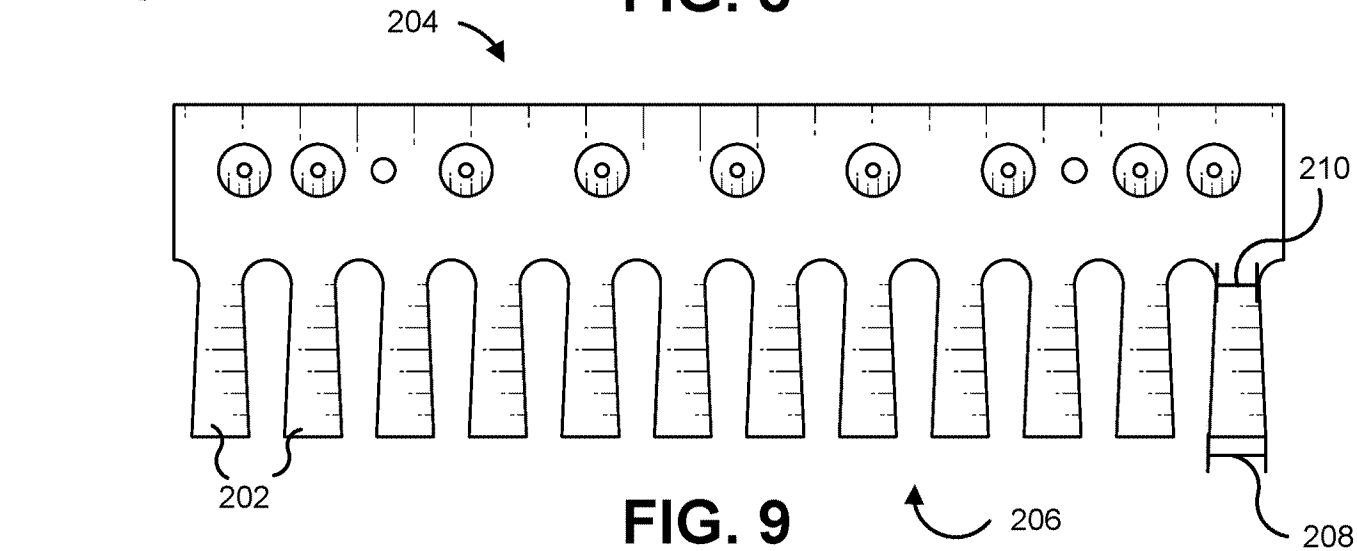
FIG. 9 is a plan view of an example attachment element of an example cutting edge assembly described herein.

FIGS. 8-9 are diagrams of views of an example attachment element 200 of an example cutting edge assembly (e.g., cutting edge assembly 100) described herein. Attachment element 200 may correspond to attachment element 102. As shown in FIGS. 8-9, attachment element 200 includes a plurality of retention structures 202 (referred to herein individually as "retention structure 202," and collectively as "retention structures 202") that extend from an attachment end 204 of attachment element 200 toward a cutting edge end 206 of attachment element 200. Attachment end 204 may correspond to a proximal end of the cutting edge assembly, and cutting edge end 206 may be toward a distal end of the cutting edge assembly.

Retention structures 202 are configured to form a mechanical bond and/or metallurgical bond with a wear element (e.g., wear element 104). For example, to form a mechanical bond, retention structures 202 may be formed to interface with the wear element. To form a metallurgical bond, a bimetal alloy product may be formed from surfaces of retention structures 202 interfacing (e.g., melting, intermingling, bonding and/or the like) with a metal alloy used to form the wear element.

Retention structures 202 may have a first width 208 (e.g., a base width) that is toward cutting edge end 206 and a second width 210 that is toward an attachment end 204 (e.g., retention structures 202 may be wider at the bottom (toward the cutting edge end) than at the top (toward the attachment end)). Accordingly, because primary forces on the cutting edge assembly are generally pulled by cutting edge end 206 of attachment element 200 by a wear element (e.g., that is cast over attachment element 200), the mechanical bond formed and caused by the thicker width of retention structures 202 toward cutting edge end 206 may create a mechanical bond that permits the wear element to grip attachment element 200. Although shown as trapezoidal in shape, retention structures 202 may be any other suitable shape that has a wider first width 208 toward a cutting edge end 206 and a narrower second width toward attachment end 204. Additionally, or alternatively, retention structures 202 may include serrated sides, toothed sides, undulating sides, and/or the like to form a mechanical bond between attachment element 200 and a wear element.

Attachment element 200 may be formed from a single piece of material comprised of a single type of metal or metal alloy. For example, attachment element 200 may be formed from a piece of steel. In some implementations, attachment element 200 may be stamped, laser cut, flame cut, water cut, and/or the like from the piece of steel.

As indicated above, FIGS. 8-9 are provided as one or more examples. Other examples may differ from what is described in connection with FIGS. 8-9.

Figure 10:
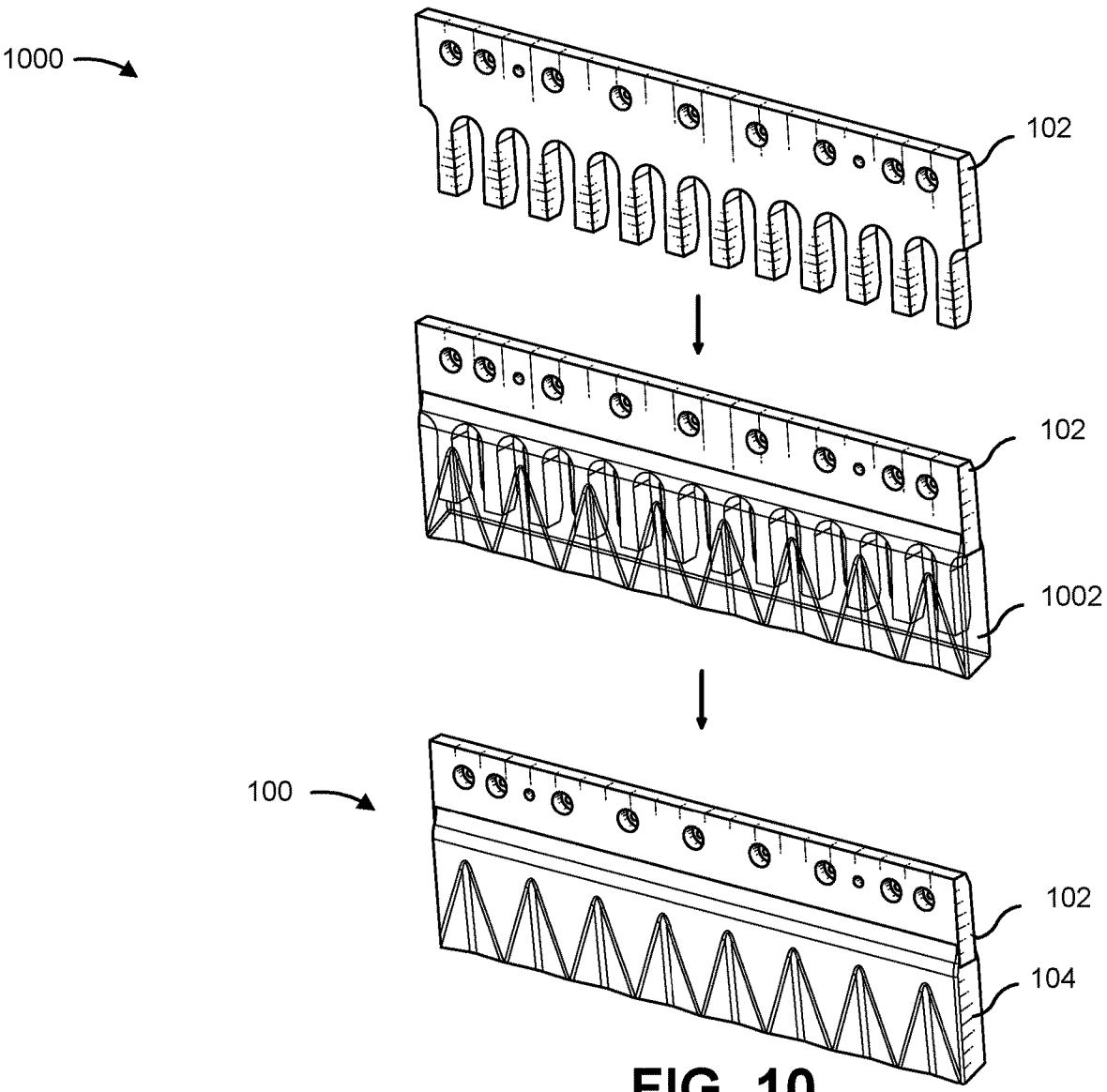
FIG. 10 is a diagram of an example implementation described herein.

FIG. 10 is a diagram of an example implementation 1000 described herein. As shown in FIG. 10, an attachment element 102 (e.g., corresponding to attachment element 200 and/or attachment element 102 of FIGS. 4-7) may be combined with a wear element 104 (e.g., corresponding to wear element 104 of FIGS. 4-7) to form cutting edge assembly 100 (e.g., corresponding to cutting edge assembly 100 of FIGS. 4-7).

For example, after being formed in example implementation 1000, attachment element 102 may be placed into contact with molten white iron that is in a mold structure 1002, to form cutting edge assembly 100. Attachment element 102 may be placed in contact with the molten white iron within a threshold time period of being formed. For example, after being flame cut, attachment element 102 may be placed in contact with the molten white iron while surfaces of retention structures (e.g., retention structure 202) of attachment element 102 are at a threshold temperature (e.g., approximately 425° C. to 500° C.), which may result from flame cutting the attachment element 102 from the piece of steel. In some implementations, attachment element 102 may be pretreated (e.g., preheated to a particular temperature, supplied with a substance (e.g., flux) to facilitate a metallurgical bond, and/or the like) before being placed in contact with the molten white iron.

Once formed, cutting edge assembly 100 may undergo one or more heat treatment processes to harden wear element 104 (e.g., to cause a microstructure of wear element 104 to have a particular hardness and/or formation). For example, a heat treatment process may include one or more cycles of applying heat to cutting edge assembly 100, causing cutting edge assembly 100 to be a particular temperature for a particular length of time, and/or cooling cutting edge assembly 100 (or bring cutting edge assembly 100 to an ambient temperature) for use. More specifically, cutting edge assembly 100 may be placed in a temperature-controlled space (e.g., an oven, a kiln, and/or the like) as the temperature is adjusted (e.g., increased) at various rates, for various durations, and/or the like.

Accordingly, a heat treatment of cutting edge assembly 100 may include multiple cycles of adjusting a temperature of cutting edge assembly 100 (e.g., by causing an increase or decrease of a temperature of a temperature-controlled space that is housing cutting edge assembly 100) from one temperature to a holding temperature and maintaining the temperature at that holding temperature for a period of time. The various rates of adjusting the temperature may be any suitable linear rate, such as 35° C. per hour, 10° C. per hour, 5° C. per hour, and/or the like. Additionally, or alternatively, the temperature may be variably increased or decreased, exponentially increased or decreased, and/or the like between holding temperatures. The cutting edge assembly 100 may be held, during a particular cycle of a heat treatment, at a particular temperature for any suitable duration (such as 30 minutes, an hour, four hours, a day, and/or the like). Settings (e.g., temperature adjustment rates, holding temperatures, lengths of maintaining holding temperatures, and/or the like) of each of the individual cycles of a heat treatment may be based on the type of metal alloy used to form wear element 104 (e.g., based on a percentage of chrome or other metal in wear element 104).

According to some aspects, a heat treatment of cutting edge assembly 100 may involve adjusting a composition of air in a temperature-controlled room. For example, after a plurality of cycles of gradually increasing and holding the temperature to a maximum holding temperature of the heat treatment, air may be withdrawn from the temperature-controlled room until cutting edge assembly 100 cools to a particular temperature (e.g., between 500° C. and 600° C.). Cutting edge assembly 100 may then be air cooled until cutting edge assembly cools to ambient temperature to complete the heat treatment. In this way, during a heat treatment, the temperature of cutting edge assembly 100 may be adjusted to various temperatures, at various rates, for various periods of time to cause a particular microstructure of cutting edge assembly 100 to form (thus resulting in cutting edge assembly 100 having a particular flexibility enabled by attachment element 102 and a particular hardness enabled by wear element 104).

As indicated above, FIG. 10 is provided as an example. Other examples may differ from what is described with regard to FIG. 10.

Figure 11:
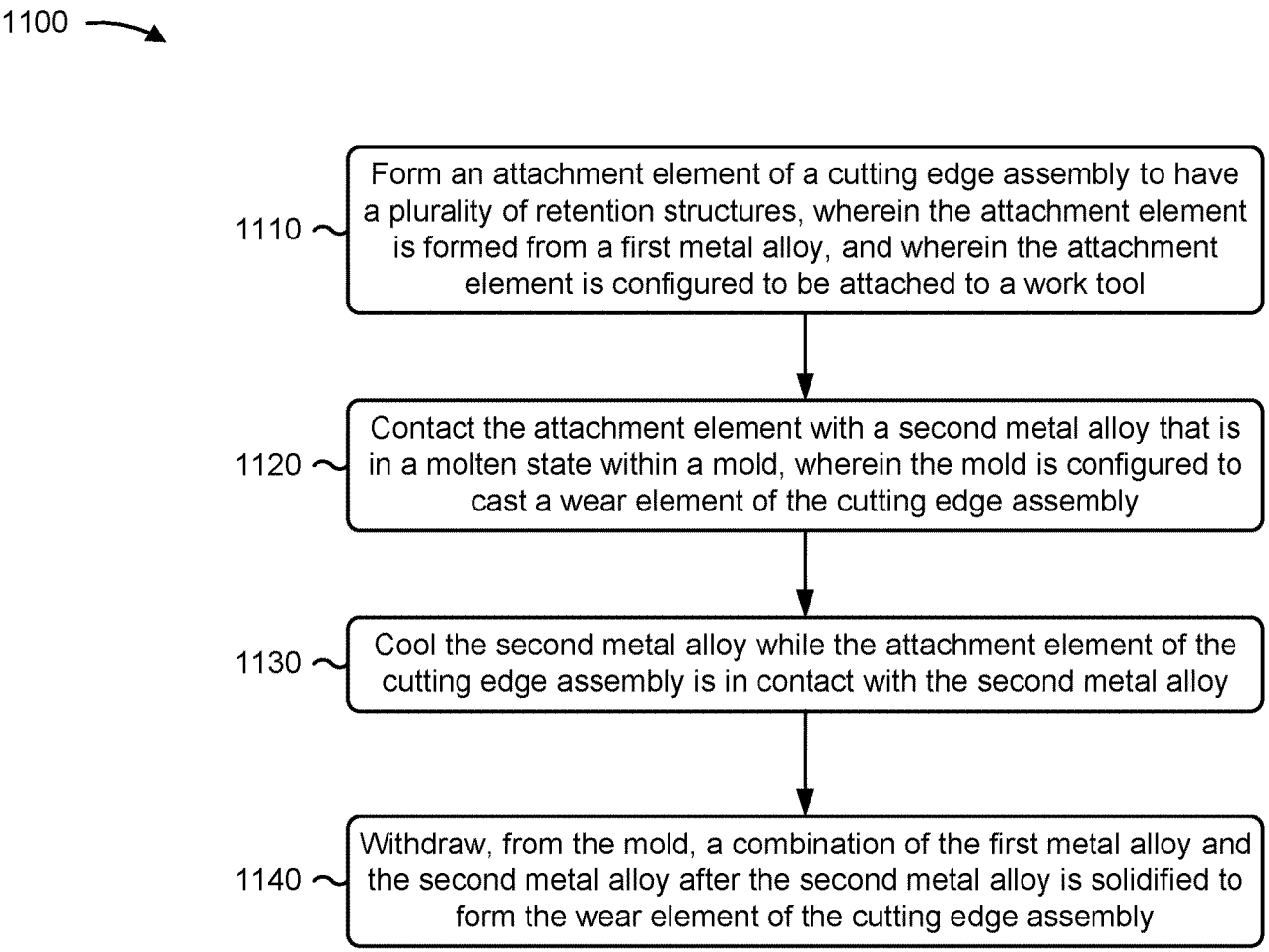
FIGS. 11 and 12 are flowcharts associated with forming and/or manufacturing a cutting edge assembly as described herein.

FIG. 11 is a flowchart of an example process 1100 that may be performed to prepare a cutting edge assembly described herein. In some implementations, one or more process blocks of FIG. 11 may be performed by one or more manufacturing devices configured to form and/or manufacture a cutting edge assembly (e.g., cutting edge assembly 100).

As shown in FIG. 11, process 1100 may include forming an attachment element of a cutting edge assembly to have a plurality of retention structures, wherein the attachment element is formed from a first metal alloy, and wherein the attachment element of the cutting edge assembly is configured to be attached to a work tool (block 1110). For example, the cutting edge assembly may be formed to include an attachment element with a plurality of retention structures, as described above. In some implementations, the attachment element is formed (e.g., flame cut, laser cut, stamped, and/or the like) from a piece of steel material or rolled steel.

As further shown in FIG. 11, process 1100 may include contacting the attachment element with a second metal alloy that is in a molten state within a mold, wherein the mold is configured to cast a wear element of the cutting edge assembly (block 1120). For example, the cutting edge assembly may be formed from placing the attachment element in contact with a molten second metal alloy within a mold that is formed for a wear element of the cutting edge assembly, as described above.

According to some implementations, a metallurgical bond is formed between the first metal alloy and the second metal alloy as the second metal alloy is cooled. For example, molten white iron, when cast over a steel attachment element, may meld to the steel attachment element (e.g., specifically to surfaces of the retention structures of the steel attachment element) to form a metallurgical bond (e.g., due to the steel and white iron having similar melting temperatures). In some instances, to facilitate forming the metallurgical bond, the steel attachment element may be pretreated. For example, the steel attachment element may be preheated and/or supplied (or coated) with a substance to accelerate the formation of the metallurgical bond. Additionally, or alternatively, the retention structures may be shaped to establish a mechanical bond between the wear element and the attachment element.

To place a steel attachment element in contact with molten white iron, the steel attachment may be suspended within the mold and the molten white iron may be poured into the mold so that the white iron wear element is cast over the steel attachment element. Additionally, or alternatively, the steel attachment element may be placed in contact with the molten white iron by dipping the steel attachment element into the mold, which was previously supplied with the molten white iron.

As further shown in FIG. 11, process 1100 may include cooling the second metal alloy while the attachment element of the cutting edge assembly is in contact with the second metal alloy (block 1130). For example, the cutting edge assembly may be formed by cooling the molten white iron to a solid state, as described above. The molten white iron may be cooled based on removing heat from the molten white iron, exposing the molten white iron to cooler temperatures, supplying the mold and/or the molten white iron with cooling fluids (e.g., gas, air, water, and/or the like), and/or the like. Accordingly, any suitable processes may be performed to cool and/or solidify the molten white iron.

As further shown in FIG. 11, process 1100 may include withdrawing, from the mold, a combination of the first metal alloy and the second metal alloy after the second metal alloy is solidified to form the wear element of the cutting edge assembly (block 1140). For example, after the cooling process (and/or a curing process) solidifies the molten white iron to cast the wear element over the attachment element, the cutting edge assembly (formed from the solid combination of the wear element and the attachment element) may be removed from the mold, as described above. In some instances, one or more additional curing processes and/or finishing processes (e.g., sanding, polishing, coating, and/or the like) may be performed to finish manufacturing the cutting edge assembly.

Process 1100 may include additional implementations, such as any single implementation or any combination of implementations described in connection with one or more other processes described elsewhere herein.

Although FIG. 11 shows example blocks of process 1100, in some implementations, process 1100 may include additional blocks, fewer blocks, different blocks, or differently arranged blocks than those depicted in FIG. 11. Additionally, or alternatively, two or more of the blocks of process 1100 may be performed in parallel.

Figure 12:
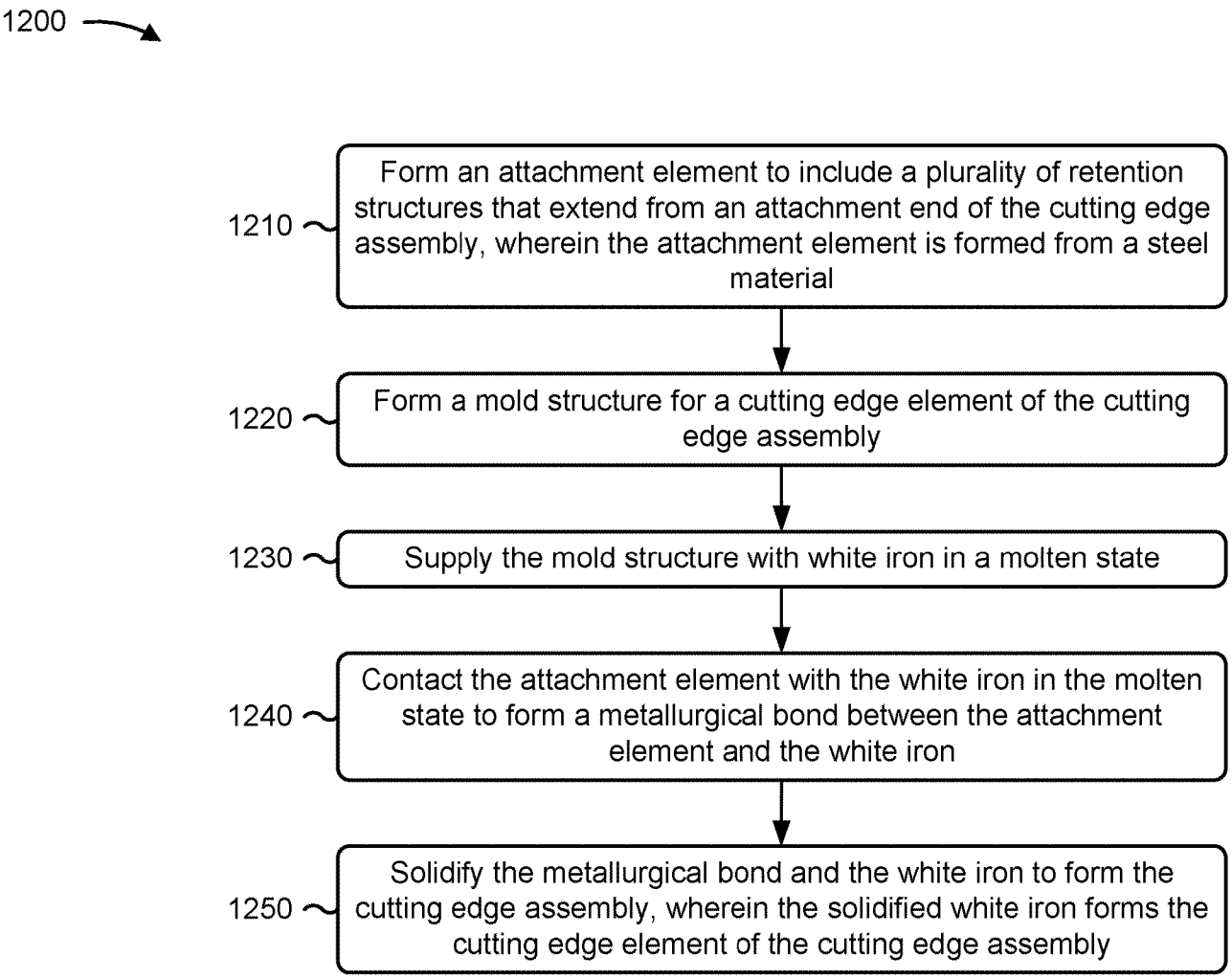

FIG. 12 is a flowchart of an example process 1200 for manufacturing a cutting edge assembly for a work tool associated with a machine. In some implementations, one or more process blocks of FIG. 12 may be performed by one or more manufacturing devices configured to form and/or manufacture a cutting edge assembly (e.g., cutting edge assembly 100).

As shown in FIG. 12, process 1200 may include forming an attachment element to include a plurality of retention structures that extend from an attachment edge of the cutting edge assembly, wherein the attachment element is formed from a steel material (block 1210). For example, the attachment element may be formed by stamping, laser cutting, and/or flame cutting the attachment element from the steel material. As described herein, the attachment element is formed to include a plurality of retention structures that extend from an attachment end of the cutting edge assembly, as described above.

As further shown in FIG. 12, process 1200 may include forming a mold structure for a wear element of the cutting edge assembly (block 1220). For example, the mold structure may be formed to permit a white iron wear element to be cast over the steel attachment element, as described above.

As further shown in FIG. 12, process 1200 may include supplying the mold structure with white iron in a molten state (block 1230). For example, the wear element of the cutting edge assembly formed from molten white iron supplied to the mold structure, as described above.

As further shown in FIG. 12, process 1200 may include contacting the attachment element with the white iron in the molten state to form a metallurgical bond between the attachment element and the white iron (block 1240). In some implementations, the metallurgical bond is formed based on the attachment element being pretreated by at least one of supplying a flux substance to surfaces of the attachment element (e.g., to surface of the plurality of retention structures), or preheating the plurality of retention structures to a bonding temperature (e.g., approximately 425° C. to 500° C.).

As further shown in FIG. 12, process 1200 may include curing the metallurgical bond and the white iron to form the cutting edge assembly, wherein the solidified white iron forms the wear element of the cutting edge assembly (block 1250). For example, the metallurgical bond and the white iron may be solidified by performing one or more processes (e.g., removing from heat, supplying coolant, and/or the like) to cause the white iron to transition from the molten state to a solid state.

Process 1200 may include additional implementations in connection with one or more other processes described elsewhere herein.

Although FIG. 12 shows example blocks of process 1200, in some implementations, process 1200 may include additional blocks, fewer blocks, different blocks, or differently arranged blocks than those depicted in FIG. 12. Additionally, or alternatively, two or more of the blocks of process 1200 may be performed in parallel.

INDUSTRIAL APPLICABILITY

The disclosed cutting edge assembly with a relatively harder metal or metal alloy cast over a relatively lighter and flexible metal or metal alloy may be applicable to any machine having a work tool. Several advantages may be associated with the cutting edge assembly according to various implementations of this disclosure.

The cutting edge assembly may be relatively flexible and light while maintaining strength and improved wear life. For example, the cutting edge assembly may include a steel attachment element that provides flexibility and may be lightweight, thus enabling improved maneuverability, decreasing stresses on other components of the machine, and/or the like (e.g., relative to a purely (or primarily) white iron cutting edge assembly, that may increase wear and tear on components of the machine due to being heavy and more rigid, causing more vibration of the machine under operation). Meanwhile, the white iron wear element may permit a relatively strong and long-lasting cutting edge assembly (e.g., relative to a purely (or primarily) steel cutting edge assembly or a cutting edge assembly that includes white iron teeth and/or individual pieces of white iron received within a primarily steel cutting edge assembly).

The cutting edge assembly may exhibit improved penetration performance and longer wear life. For example, the indentations of wear element may penetrate and break up hard and/or frozen ground, and may direct the flow of material passing by the cutting edge assembly when the cutting edge assembly is moved horizontally and/or vertically into the ground. Furthermore, the indentations of the wear element may permit a continuous cutting edge, thereby allowing for relatively simply molds to be configured to cast the wear element over the attachment element (thus minimizing costs and/or strength of the molds themselves by not having to create serrated edges and/or teeth).

Furthermore, forming cutting edge assembly by casting a white iron wear element over a steel attachment element may be relatively simpler to manufacturer and more cost effective. For example, placing the attachment element in contact with molten white iron may be much simpler than brazing the white iron to the attachment element (which may be performed in previous techniques to form white iron teeth). Furthermore, using the molten white iron, a metallurgical bond can be formed between the steel attachment element and the white iron wear element.

As used herein, the articles "a" and "an" are intended to include one or more items, and may be used interchangeably with "one or more." Also, as used herein, the terms "has," "have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. A cutting edge assembly comprising:

an attachment element configured to be attached to a work tool of a machine, wherein the attachment element is formed from a first metal alloy, and wherein the attachment element includes a plurality of retention structures that extend from an attachment end of the attachment element toward a cutting edge end of the attachment element; and a wear element configured to form a cutting edge of the work tool, wherein the wear element is formed from a second metal alloy that is different from the first metal alloy, and wherein the wear element is cast over the plurality of retention structures to bond the wear element to the attachment element.

2. The cutting edge assembly of claim 1, wherein the plurality of retention structures have a first width and a second width, wherein the first width is wider than the second width, and wherein the first width is toward the cutting edge end of the attachment element and the second width is toward the attachment end of the attachment element.

3. The cutting edge assembly of claim 1, wherein a base of the wear element is a continuous edge that aligns with a continuous plane of the cutting edge of the work tool.

4. The cutting edge assembly of claim 1, wherein the first metal alloy is more flexible than the second metal alloy.

5. The cutting edge assembly of claim 1, wherein the first metal alloy is less wear resistant than the second metal alloy.

6. The cutting edge assembly of claim 1, wherein the wear element includes a plurality of indentations relative to a face of the wear element.

7. The cutting edge assembly of claim 6, wherein a lateral width of one or more of the plurality of the indentations is wider at a base of the wear element than at the attachment end of the wear element.

8. The cutting edge assembly of claim 6, wherein the plurality of indentations have the same dimensions within a tolerance threshold.

9. The cutting edge assembly of claim 1, wherein the first metal alloy is steel and the second metal alloy is white iron.

10. The cutting edge assembly of claim 1, wherein the wear element is bonded to the attachment element via a metallurgical bond.

11. A cutting edge assembly for use on a work tool of a machine, wherein the cutting edge assembly is prepared by a process comprising:

forming an attachment element of the cutting edge assembly to have a plurality of retention structures, wherein the attachment element is formed from a first metal alloy, and wherein the attachment element of the cutting edge assembly is configured to be attached to the work tool;

contacting the attachment element with a second metal alloy that is in a molten state within a mold, wherein the mold is configured to cast a wear element of the cutting edge assembly;

cooling the second metal alloy while the attachment element of the cutting edge assembly is in contact with the second metal alloy; and withdrawing, from the mold, a combination of the first metal alloy and the second metal alloy after the second metal alloy is solidified to form the wear element of the cutting edge assembly.

12. The cutting edge assembly of claim 11, wherein a metallurgical bond is formed between the first metal alloy and the second metal alloy as the second metal alloy is cooled.

13. The cutting edge assembly of claim 11, wherein one or more of the plurality of retention structures are shaped to establish a mechanical bond between the wear element and the attachment element.

14. The cutting edge assembly of claim 11, wherein the first metal alloy is steel and the second metal alloy is white iron.

15. The cutting edge assembly of claim 11, wherein, prior to contacting the attachment element to the wear element, the attachment element is preheated to a threshold temperature to permit a metallurgical bond to form between the first metal alloy and the second metal alloy after the attachment element is contacted with the second metal alloy.

16. The cutting edge assembly of claim 11, wherein the attachment element is contacted with the second metal alloy that is in the molten state while the second metal alloy is in a mold structure formed to create a cutting edge of the cutting edge assembly.

17. The cutting edge assembly of claim 11, wherein the attachment element is contacted with the second metal alloy after being suspended in a mold structure formed to create a cutting edge of the cutting edge assembly, and wherein the second metal alloy is poured into the mold structure.

18. A method of manufacturing a cutting edge assembly of a work tool of a machine, the method comprising:

forming an attachment element to include a plurality of retention structures that extend from an attachment end of the cutting edge assembly, wherein the attachment element is formed from a steel material;

forming a mold structure for a wear element of the cutting edge assembly;

supplying the mold structure with white iron in a molten state;

contacting the attachment element with the white iron in the molten state to form a metallurgical bond between the attachment element and the white iron; and curing the metallurgical bond and the white iron to form the cutting edge assembly, wherein the solidified white iron forms the wear element of the cutting edge assembly.

19. The method of claim 18, wherein curing the metallurgical bond and the white iron comprises cooling the white iron until the white iron transitions from the molten state to a solid state.

20. The method of claim 18, wherein the metallurgical bond is formed based on the attachment element being pretreated by at least one of:

supplying a flux substance to surfaces of the plurality of retention structures, or preheating the plurality of retention structures to a bonding temperature.

* * * * *